US008121841B2

(12) United States Patent
Badino et al.

(10) Patent No.: US 8,121,841 B2
(45) Date of Patent: Feb. 21, 2012

(54) TEXT-TO-SPEECH METHOD AND SYSTEM, COMPUTER PROGRAM PRODUCT THEREFOR

(75) Inventors: Leonardo Badino, Turin (IT); Claudia Barolo, Turin (IT); Silvia Quazza, Turin (IT)

(73) Assignee: Loquendo S.p.A., Turin (IT)

( * ) Notice: Subject to any disclaimer, the term of this patent is extended or adjusted under 35 U.S.C. 154(b) by 919 days.

(21) Appl. No.: 10/582,849

(22) PCT Filed: Dec. 16, 2003

(86) PCT No.: PCT/EP03/14314

§ 371 (c)(1),
(2), (4) Date: Jun. 14, 2006

(87) PCT Pub. No.: WO2005/059895

PCT Pub. Date: Jun. 30, 2005

(65) Prior Publication Data

US 2007/0118377 A1 May 24, 2007

(51) Int. Cl.
*G10L 13/08* (2006.01)

(52) U.S. Cl. ..... 704/260; 704/258; 704/269

(58) Field of Classification Search ..... 704/260, 704/258, 269

See application file for complete search history.

(56) References Cited

U.S. PATENT DOCUMENTS

| | | | | |
|---|---|---|---|---|
| 6,088,673 | A * | 7/2000 | Lee et al. | 704/260 |
| 6,141,642 | A * | 10/2000 | Oh | 704/260 |
| 7,043,431 | B2 * | 5/2006 | Riis et al. | 704/259 |
| 2005/0144003 | A1 * | 6/2005 | Iso-Sipila | 704/269 |

OTHER PUBLICATIONS

Jensen, K., Riis, S., and Morten Pedersen. "Multilingual Text-To-Phoneme mapping for Speaker Independent name Dialing in Mobile Terminals." RTO-MP-066, Sep. 2001.*

Schultz, T. and Waibel, A. "Language Independent and Language Adaptive Large Vocabulary Speech Recognition." ICSLP, 1998.*

Traber et al., "From Multilingual to Polyglot Speech Synthesis", Proceedings of the Eurospeech, pp. 835-838, (1999).

Campbell, "Foreign-Language Speech Synthesis", XP002285739, Proceedings of ESCA/COCOSDA Workshop on Speech Synthesis, pp. 177-180, (1998).

Campbell, "Talking Foreign, Concatenative Speech Synthesis and the Language Barrier", XP007005007, Eurospeech, vol. 1, pp. 337-340, (2001).

Badino et al., "A General Approach to TTS Reading of Mixed-Language Texts", XP002292957, Proceedings of the 5th ISCA Speech Synthesis Workshop, pp. 1-5, (2004).

Badino et al., "Language Independent Phoneme Mapping for Foreign TTS", XP002292958, Proceedings of the 5th ISCA Speech Synthesis Workshop, pp. 217-218, (2004).

* cited by examiner

*Primary Examiner* — Talivaldis Ivars Smits
*Assistant Examiner* — Shaun Roberts
(74) *Attorney, Agent, or Firm* — Hamilton, Brook, Smith & Reynolds, P.C.

(57) ABSTRACT

A text-to-speech system adapted to operate on text in a first language including sections in a second language, includes a grapheme/phoneme transcriptor for converting the sections in the second language into phonemes of the second language; a mapping module configured for mapping at least part of the phonemes of the second language onto sets of phonemes of the first language; and a speech-synthesis module adapted to be fed with a resulting stream of phonemes including the sets of phonemes of the first language resulting from mapping and the stream of phonemes of the first language representative of the text, and to generate a speech signal from the resulting stream of phonemes.

17 Claims, 8 Drawing Sheets

TEXT-TO-SPEECH METHOD AND SYSTEM, COMPUTER PROGRAM PRODUCT THEREFOR

CROSS REFERENCE TO RELATED APPLICATION

Figure 1:
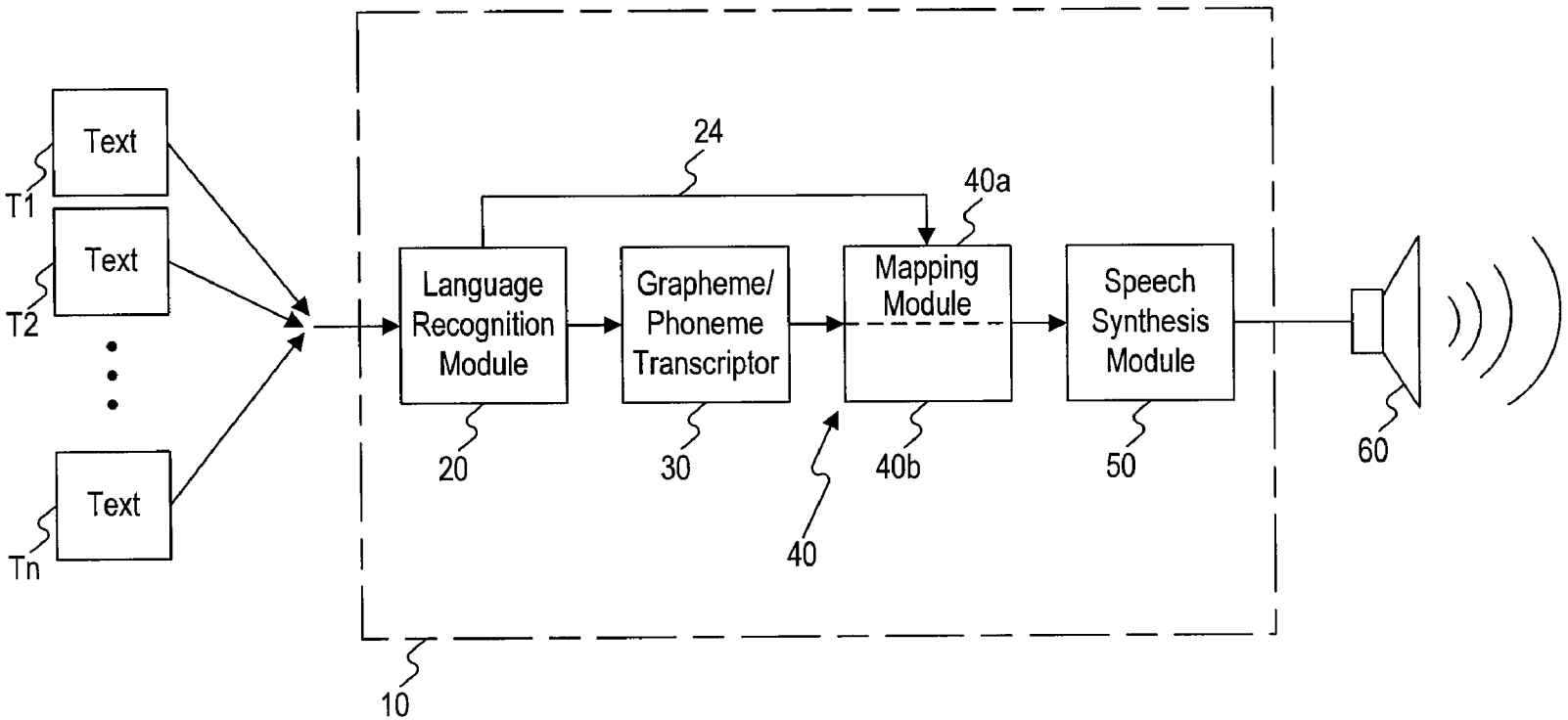

This application is a national phase application based on PCT/EP2003/014314, filed Dec. 16, 2003, the content of which is incorporated herein by reference.

FIELD OF THE INVENTION

The present invention relates to text-to-speech techniques, namely techniques that permit a written text to be transformed into an intelligible speech signal.

DESCRIPTION OF THE RELATED ART

Text-to-speech systems are known based on so-called "unit selection concatenative synthesis". This requires a database including pre-recorded sentences pronounced by mother-tongue speakers. The vocalic database is single-language in that all the sentences are written and pronounced in the speaker language.

Text-to-speech systems of that kind may thus correctly "read" only a text written in the language of the speaker while any foreign words possibly included in the text could be pronounced in an intelligible way, only if included (together with their correct phonetization) in a lexicon provided as a support to the text-to-speech system. Consequently, multi lingual texts can be correctly read in such systems only by changing the speaker voice in the presence of a change in the language. This gives rise to a generally unpleasant effect, which is increasingly evident when the changes in the language occur at a high frequency and are generally of short duration.

Additionally, a current speaker having to pronounce foreign words included in a text in his or her own language will be generally inclined to pronounce these words in a manner that may differ—also significantly—from the correct pronunciation of the same words when included in a complete text in the corresponding foreign language.

By way of example, a British or American speaker having to pronounce e.g. an Italian name or surname included in an English text will generally adopt a pronunciation quite different from the pronunciation adopted by a native Italian speaker in pronouncing the same name and surname. Correspondingly, an English-speaking subject listening to the same spoken text will generally find it easier to understand (at least approximately) the Italian name and surname if pronounced as expectedly "twisted" by an English speaker rather than if pronounced with the correct Italian pronunciation.

Similarly, pronouncing e.g. the name of a city in the UK or the United States included in an Italian text read by an Italian speaker by adopting the correct British English or American English pronunciation will be generally regarded as an undue sophistication and, as such, rejected in common usage.

The problem of reading a multi lingual text has been already tackled in the past by adopting essentially two different approaches.

On the one hand, attempts were made of producing multi lingual vocalic databases by resorting to bilingual or multi lingual speakers. Exemplary of such an approach is the article by C. Traber et al.: "From multilingual to polyglot speech synthesis" —Proceedings of the Eurospeech, pages 835-838, 1999.

This approach is based on assumptions (essentially, the availability of a multi-lingual speaker) that are difficult to encounter and to reproduce. Additionally, such an approach does not generally solve the problem generally associated to foreign words included in a text expected to be pronounced in a (possibly remarkably) different manner from the correct pronunciation in the corresponding language.

Another approach is to adopt a transcriptor for a foreign language and the phonemes produced at its output which, in order to be pronounced, are mapped onto the phonemes of the languages of the speaker voice. Exemplary of this latter approach are the works by W.N. Campbell "Foreign-language speech synthesis" Proceedings ESCA/COCSDA ETRW on Speech Synthesis, Jenolan Caves, Australia, 1998 and "Talking Foreign. Concatenative Speech Synthesis and Language Barrier", Proceedings of the Eurospeech Scandinavia, pages 337-340, 2001.

The works by Campbell essentially aim at synthesizing a bilingual text, such as English and Japanese, based on a voice generated starting from a monolingual Japanese database. If the speaker voice is Japanese and the input text English, an English transcriptor is activated to produce English phonemes. A phonetic mapping module maps each English phoneme onto a corresponding, similar Japanese phoneme. The similarity is evaluated based on the phonetic—articolatory categories. Mapping is carried out by a searching a look-up table providing a correspondence between Japanese and English phonemes.

As a subsequent step, the various acoustic units intended to compose the reading by a Japanese voice are selected from the Japanese database based on their acoustic similarities with the signals generated when synthesizing the same text with an English voice.

The core of the method proposed by Campbell is a lookup-table expressing the correspondence between phonemes in the two languages. Such table is created manually by investigating the features of the two languages considered.

In principle, such an approach is applicable to any other pair of languages, but each language pair requires an explicit analysis of the correspondence therebetween. Such an approach is quite cumbersome, and in fact practically infeasible in the case of a synthesis system including more than two languages, since the number of language pairs to be taken into account will rapidly become very large.

Additionally, more than one speaker is generally used for each language, having at least slightly different phonologic systems. In order to put any speaker voice in a condition to speak all the languages available, a respective table would be required for each voice—language pair.

In the case of a synthesis system including N languages and M speaker voices (obviously, M is equal or larger than N), with look-up tables for the first phonetic mapping step, if the phonemes for one speaker voice are mapped onto those of a single voice for each foreign language, then N-1 different tables will have to be generated for each speaker voice, thus adding up to a total of N*(M−1) look-up tables.

In the case of a synthesis system operating with fifteen languages and two speaker voices for each language (which corresponds to a current arrangement adopted in the Loquendo TTS text-to-speech system developed by the Assignee of the instant application) then 435 look-up table would be required. That figure is quite significant, especially if one takes into account the possible requirement of generating such look-up tables manually.

Expanding such a system to include just one new speaker voice speaking one new language would require M+N=45 new tables to be added. In that respect, one has to take into account that new phonemes are frequently added to text-to-speech systems for one or more languages, this being a common case when the new phoneme added is an allophone of an already existing phoneme in the system. In that case, the need will exist of reviewing and modifying all those look-up tables pertaining to the language(s) to which the new phoneme is being added.

OBJECT AND SUMMARY OF THE INVENTION

In view of the foregoing, the need exists for improved text-to-speech systems dispensing with the drawbacks of the prior art of the arrangements considered in the foregoing. More specifically, the object of the present invention is to provide a multi lingual text-to-speech system that:

- may dispense with the requirement of relying on multilingual speakers, and
- may be implemented by resorting to simple architectures, with moderate memory requirements, while also dispensing with the need of generating (possibly manually) a relevant number of look-up tables, especially when the system is improved with the addition of a new phoneme for one or more languages.

According to the present invention, that object is achieved by means of a method having the features set forth in the claims that follow. The invention also relates to a corresponding text-to-speech system and a computer program product loadable in the memory of at least one computer and comprising software code portions for performing the steps of the method of invention when the product is run on a computer. As used herein, reference to such a computer program product is intended to be equivalent to reference to a computer-readable medium containing instructions for controlling a computer system to coordinate the performance of the method of the invention. Reference to "at least one computer" is evidently intended to highlight the possibility for the system of the invention to be implemented in a distributed fashion.

A preferred embodiment of the invention is thus an arrangement for the text-to-speech conversion of a text in a first language including sections in at least one second language, including:

- a grapheme/phoneme transcriptor for converting said sections in said second language into phonemes of said second language,
- a mapping module configured for mapping at least part of said phonemes of said second language onto sets of phonemes of said first language,
- a speech-synthesis module adapted to be fed with a resulting stream of phonemes including said sets of phonemes of said first language resulting from said mapping and the stream of phonemes of said first language representative of said text, and to generate a speech signal from said resulting stream of phonemes; the mapping module is configured for:
- carrying out similarity tests between each said phoneme of said second language being mapped and a set of candidate mapping phonemes of said first language,
- assigning respective scores to the results of said tests, and
- mapping said phoneme of said second language onto a set of mapping phonemes of said first language selected out of said candidate mapping phonemes as a function of said scores.

Preferably, the mapping module is configured for mapping said phoneme of said second language into a set of mapping phonemes of said first language selected out of:

- a set of phonemes of said first language including three, two or one phonemes of said first language, or
- an empty set, whereby no phoneme is included in said resulting stream for said phoneme in said second language.

Typically, mapping onto said empty set of phonemes of said first language occurs for those phonemes of said second language for which any of said scores fails to reach a threshold value.

The resulting stream of phonemes can thus be pronounced by means of a speaker voice of said first language.

Essentially, the arrangement described herein is based on a phonetic mapping arrangement wherein each of the speaker voices included in the system is capable of reading a multilingual text without modifying the vocalic database. Specifically, a preferred embodiment of the arrangement described herein seeks, among the phonemes present in the table for the language of the speaker voice, the phoneme that is most similar to the foreign language phoneme received as an input. The degree of similarity between the two phonemes can be expressed on the basis of phonetic-articolatory features as defined e.g. according to the international standard IPA. A phonetic mapping module quantifies the degree of affinity/similarity of the phonetic categories and the significance that each of them in the comparison between phonemes.

The arrangement described herein does not include any "acoustic" comparison between the segments included the database for the speaker voice language and the signal synthesized by means of the foreign language speaker voice. Consequently, the whole arrangement is less cumbersome from the computational viewpoint and dispenses with the need for the system to have a speaker voice available for the "foreign" language: the sole grapheme-phoneme transciptor will suffice.

Additionally, phonetic mapping is language independent. The comparison between phonemes refers exclusively to the vector of the phonetic features associated with each phoneme, these features being in fact language-independent. The mapping module is thus "unaware" of the languages involved, which means that no requirements exist for any specific activity to be carried out (possibly manually) for each language pair (or each voice-language pair) in the system. Additionally, incorporating new languages or new phonemes to the system will not require modifications in the phonetic mapping module.

Without losses in terms of effectiveness, the arrangement described herein leads to an appreciable simplification in comparison to prior art system, while also involving a higher degree of generalization with respect to previous solutions.

Experiments carried out show that the object of putting a monolingual speaker voice in a position to speak foreign languages in an intelligible way is fully met.

BRIEF DESCRIPTION OF THE ANNEXED DRAWINGS

The invention will now be described, by way of example only, by referring to the annexed figures of drawing, wherein:

FIG. 1 is a block diagram of a text-to-speech system adapted to incorporate the improvement described herein, and FIGS. 2 to 8 are flow charts exemplary of possible operation of the text-to-speech system of FIG. 1.

DETAILED DESCRIPTION OF PREFERRED EMBODIMENTS OF THE INVENTION

The block diagram of FIG. 1 depicts the overall architecture of a text-to-speech system of the multi lingual type.

Essentially, the system of FIG. 1 is adapted to receive as its input text that essentially qualifies as "multilingual" text.

Within the context of the invention, the significance of the definition "multilingual" is twofold:

in the first place, the input text is multilingual in that it correspond to text written in any of a plurality of different languages T1, . . . , Tn such as e.g. fifteen different languages, and in the second place, each of the texts T1, . . . , Tn is per se multilingual in that it may include words or sentences in one or more languages different from the basic language of the text.

The text T1, . . . , Tn is supplied to the system (generally designated 10) in electronic text format.

Text originally available in different forms (e.g. as hard copies of a printed text) can be easily converted into an electronic format by resorting to techniques such as OCR scan reading. These methods are well known in the art, thus making it unnecessary to provide a detailed description herein.

A first block in the system 10 is represented by a language recognition module 20 adapted to recognize both the basic language of a text input to the system and the language(s) of any "foreign" words or sentences included in the basic text.

Again, modules adapted to perform automatically such a language-recognition function are well known in the art (e.g. from orthographic correctors of word processing systems), thereby making it unnecessary to provide a detailed description herein.

In the following, in describing an exemplary embodiment of the invention reference will be made to a situation where the basic input text is an Italian text including words or short sentences in the English language. The speaker voice will also be assumed to be Italian.

Cascaded to the language-recognition module 20 are three modules 30, 40, and 50.

Specifically, module 30 is a grapheme/phoneme transcriptor adapted to segment the text received as an input into graphemes (e.g. letters or groups of letters) and convert it into a corresponding stream of phonemes. Module 30 may be any grapheme/phoneme transcriptor of a known type as included in the Loquendo TTS text-to-speech system already referred to in the foregoing.

Essentially, the output from the module 30 will be a stream of phonemes including phonemes in the basic language of the input text (e.g. Italian) having dispersed into it "bursts" of phonemes in the language(s) (e.g. English) comprising the foreign language words or short sentences included in the basic text.

Reference 40 designates a mapping module whose structure and operation will be detailed in the following. Essentially, the module 40 converts the mixed stream of phonemes output from the module 30—comprising both phonemes of the basic language (Italian) of the input text as well as phonemes of the foreign language (English)—into a stream of phonemes including only phonemes of the first, basic language, namely Italian in the example considered.

Finally, module 50 is a speech-synthesis module adapted to generate from the stream of (Italian) phonemes output from the module 40 a synthesized speech signal to be fed to a loudspeaker 60 to generate a corresponding acoustic speech signal adapted to be perceived, listened to and understood by humans.

A speech signal synthesis module such as module 60 shown herein is a basic component of any text-to-speech signal, thus making it unnecessary to provide a detailed description herein.

The following is a description of operation of the module 40.

Essentially, the module 40 is comprised of a first and a second portion designated 40*a* and 40*b*, respectively.

The first portion 40*a* is configured essentially to pass on to the module 50 those phonemes that are already phonemes of the basic language (Italian, in the example considered).

The second portion 40*b* includes a table of the phonemes of the speaker voice (Italian) and receives as an input the stream of phonemes in a foreign language (English) that are to be mapped onto phonemes of the language of the speaker voice (Italian) in order to permit such a voice to pronounce them.

As indicated in the foregoing, the module 20 indicates to the module 40 when, within the framework of a text in a given language, a word or sentence in a foreign language appears. This occurs by means of a "signal switch" signal sent from the module 20 to the module 40 over a line 24.

Once again, it is recalled that reference to Italian and English as two languages involved in the text-to-speech conversion process is merely of an exemplary nature. In fact, a basic advantage of the arrangement described herein lies in that phonetic mapping, as performed in portion 40*b* of the module 40 is language independent. The mapping module 40 is unaware of the languages involved, which means that no requirements exist for any specific activity to be carried out (possibly manually) for each language pair (or each voice-language pair) in the system.

Essentially, in the module 40 each "foreign" language phoneme is compared with all the phonemes present in the table (which may well include phonemes that—per se—are not phonemes of the basic language).

Consequently, to each input phoneme, a variable number of output phonemes may correspond: e.g. three phonemes, two phonemes, one phoneme or no phoneme at all.

For instance, a foreign diphthong will be compared with the diphthongs in the speaker voice as well as with vowel pairs.

A score is associated with each comparison performed.

The phonemes finally chosen will be those having the highest score and a value higher than a threshold value. If no phonemes in the speaker voice reach the threshold value, the foreign language phoneme will be mapped onto a nil phoneme and, therefore, no sound will be produced for that phoneme.

Each phoneme is defined in a univoque manner by a vector of n phonetic articulatory categories of variable lengths. The categories, defined-according to the IPA standard, are the following:

(a) the two basic categories vowel and consonant;

(b) the category diphthong;

(c) the vocalic (i.e. vowel) characteristics unstressed/stressed, non-syllabic, long, nasalized, rhoticized, rounded;

(d) the vowel categories front, central, back;

(e) the vowel categories close, close-close-mid, close-mid, mid, open-mid, open-open-mid, open;

(f) the consonant mode categories plosive, nasal, trill, tap-flap, fricative, lateral-fricative, approximant, lateral, affricate;

(g) the consonant place categories bilabial, labiodental, dental, alveolar, postalveolar, retroflex, palatal, velar, uvular, pharyngeal, glottal; and (h) the other consonant categories voiced, long, syllabic, aspirated, unreleased, voiceless, semiconsonant.

In actual fact, the category "semiconsonant" is not a standard IPA feature. This category is a redundant category used for the simplicity of notation to denote an approximate/alveolar/palatal consonant or an approximant-velar consonant.

The categories (d) and (e) also describe the second component of a diphthong.

Each vector contains one category (a), one or none category (b) if the phoneme is a vocal, at least one category (c) if the phoneme is a vocal, one category (d) if the phoneme is a vocal, one category (e) if the phoneme is a vocal, one category (f) if the phoneme is a consonant, at least one category (g) if the phoneme is a consonant and at least one category (h) if the phoneme is a consonant.

The comparison between phonemes is carried out by comparing the corresponding vectors, allotting respective scores to said vector-by-vector comparisons.

The comparison between vectors is carried out by comparing the corresponding categories, allotting respective score values to said category-by-category comparisons, said respective score values being aggregate to generate said scores.

Each category-by-category comparison has associated a differentiated weight, so that different category-by-category comparisons can have different weights in generating the corresponding score.

For example, a maximum score value obtained comparing (f) categories will be always lower then the score value obtained comparing (g) categories (i.e. the weight associated to category (f) comparison is higher than the weight associated to category (g) comparison). As a consequence, the affinity between vectors (score) will be influenced mostly by the similarity between categories (f), compared with the similarity between categories (g).

The process described in the following uses a set of constants having preferably the following values;

MaxCount=100
Kopen=14
Sstep=1
Mstep=2* Lstep
Lstep=4* Mstep
Kmode=Kopen+(Lstep * 2)
Thr=Kmode
Kplace3=1
Kplace2=(Kplace3 * 2)+1
Kplace1=((Kplace 2 ) * 2)+1
DecrOPen=5

Operation of the system exemplified—herein will now be described by referring to the flow charts of FIGS. 2 to 8 by assuming that a single phoneme is brought to the input of the module 40. If a plurality of phonemes are supplied as an input to the module 40, the process described in the following will be repeated for each input phoneme.

In the following a phoneme having the category diphthong or affricate will be designated "divisible phoneme".

When defining the mode and place categories of a phoneme, these are intended to be univocal unless specified differently.

For instance if a given foreign phoneme (e.g. PhonA) is termed fricative—uvular, this means that it has a single mode category (fricative) and a single place category (uvular).

By referring first to the flow chart of FIG. 2 in a step 100 an index (Indx) scanning a table of the speaker voice language (hereinafter designated TabB) is set to zero, namely positioned at the first phoneme in the table.

The score value (Score) is set to zero initial value as is the case of the variables MaxScore, TmpScrMax, FirstMaxScore, Loop and Continue. The phonemes BestPhon, FirstBest and FirstBestCmp are set at the nil phoneme.

In a step 104 the vector of the categories for the foreign phoneme (PhonA) is compared with the vector of the phoneme for a speaker voice language (PhonB).

If the two vectors are identical, the two phonemes are identical and in a step 108 the score (Score) is adjourned to the value MaxCount and the subsequent step is a step 144.

If the vectors are different, in a step 112 the base categories (a) are compared.

Three alternatives exist: both phonemes are consonants (128), both are vowels (116) or different (140).

Figure 4:
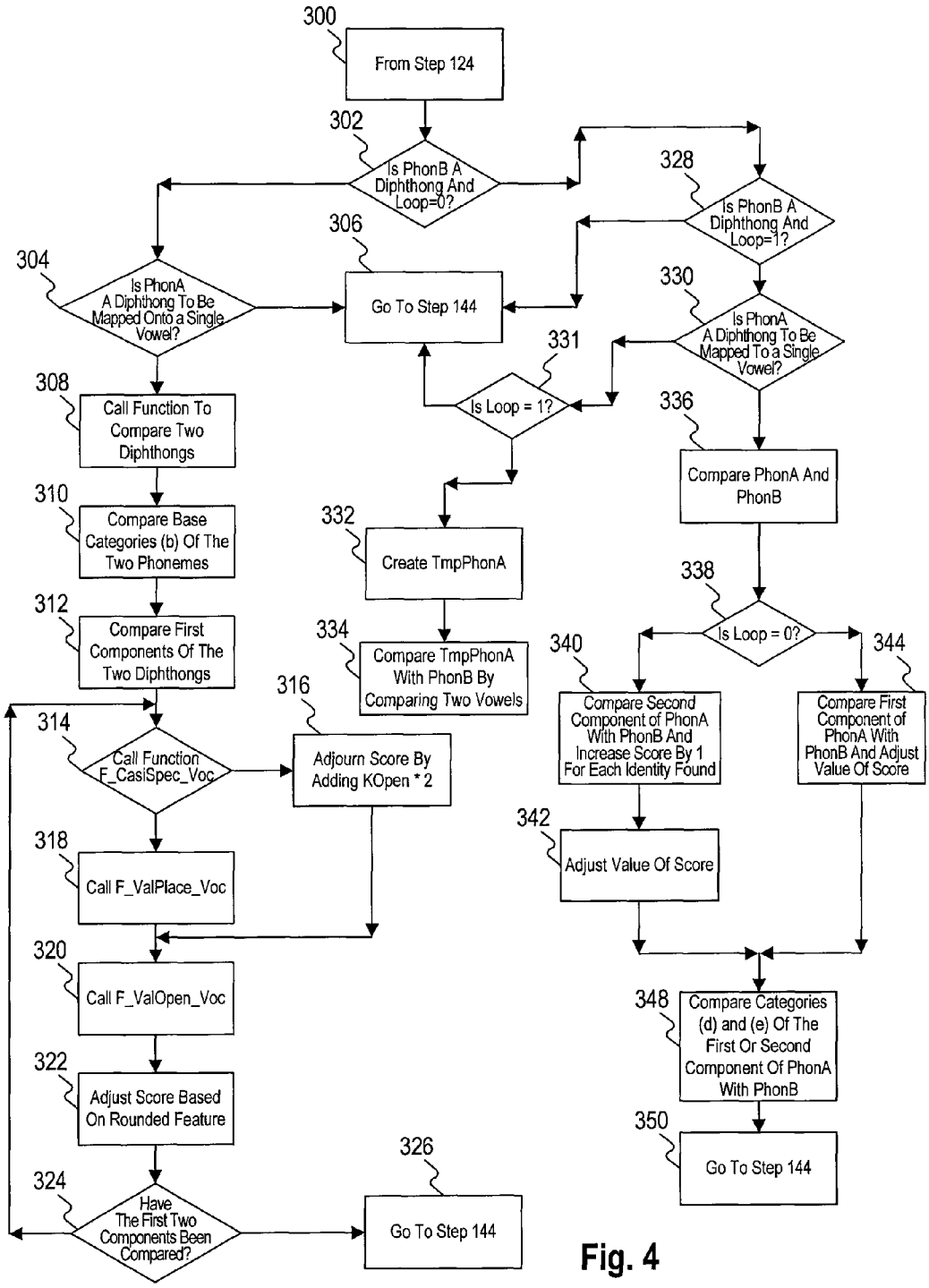

In the step 116 a check is made as to whether PhonA is a diphthong. In the positive, in a step 124 the functions described in the flow chart of FIG. 4 are activated as better detailed in the following.

Figure 5:
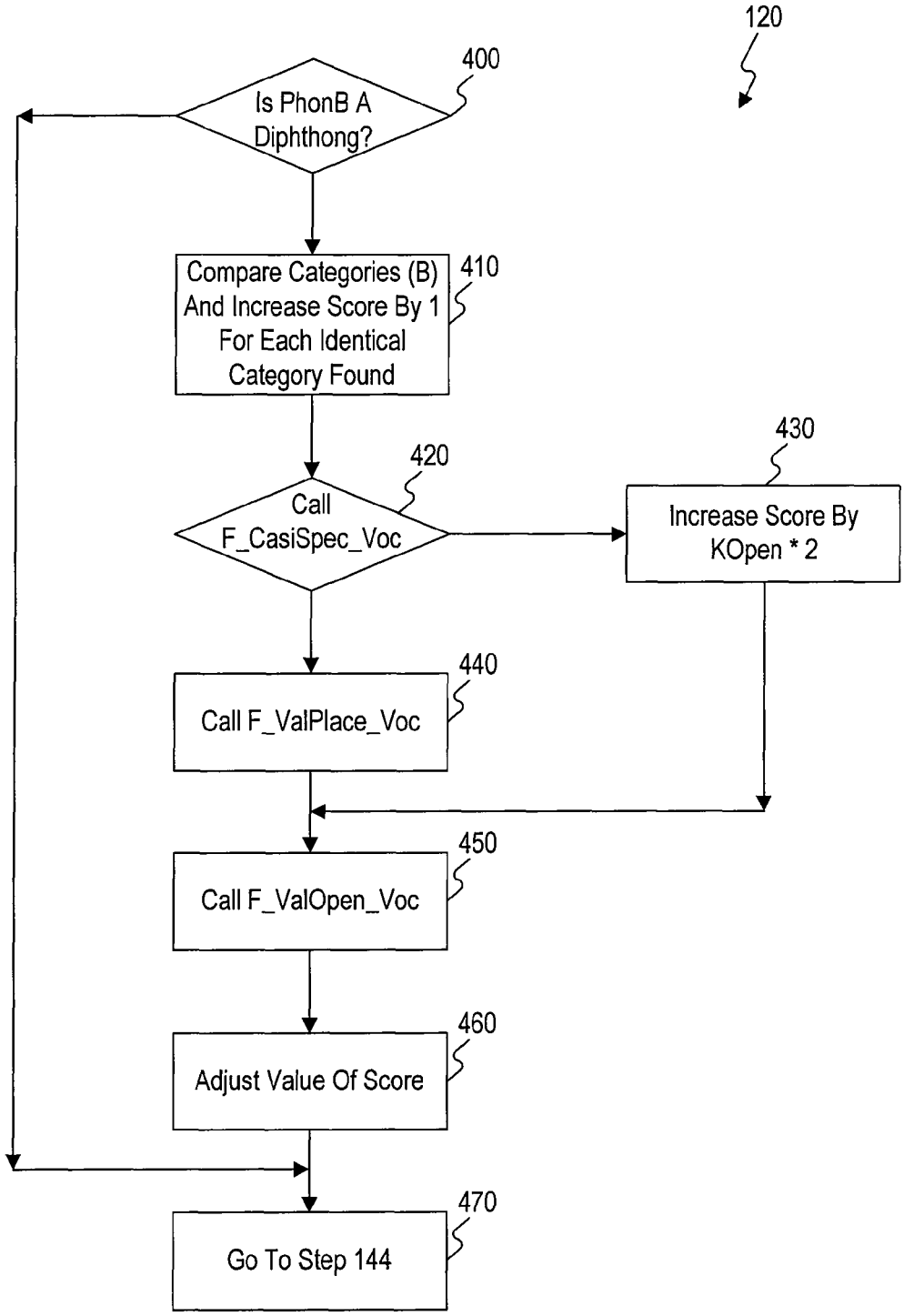

If it is not a diphthong, in a step 120, the function described in the flow chart of FIG. 5 is activated in order to compare a vowel with a vowel.

It will be appreciated that both steps 120 and 124 may lead to the score being modified as better detailed in the following.

Subsequently, processing evolves towards the step 144.

Figure 6:
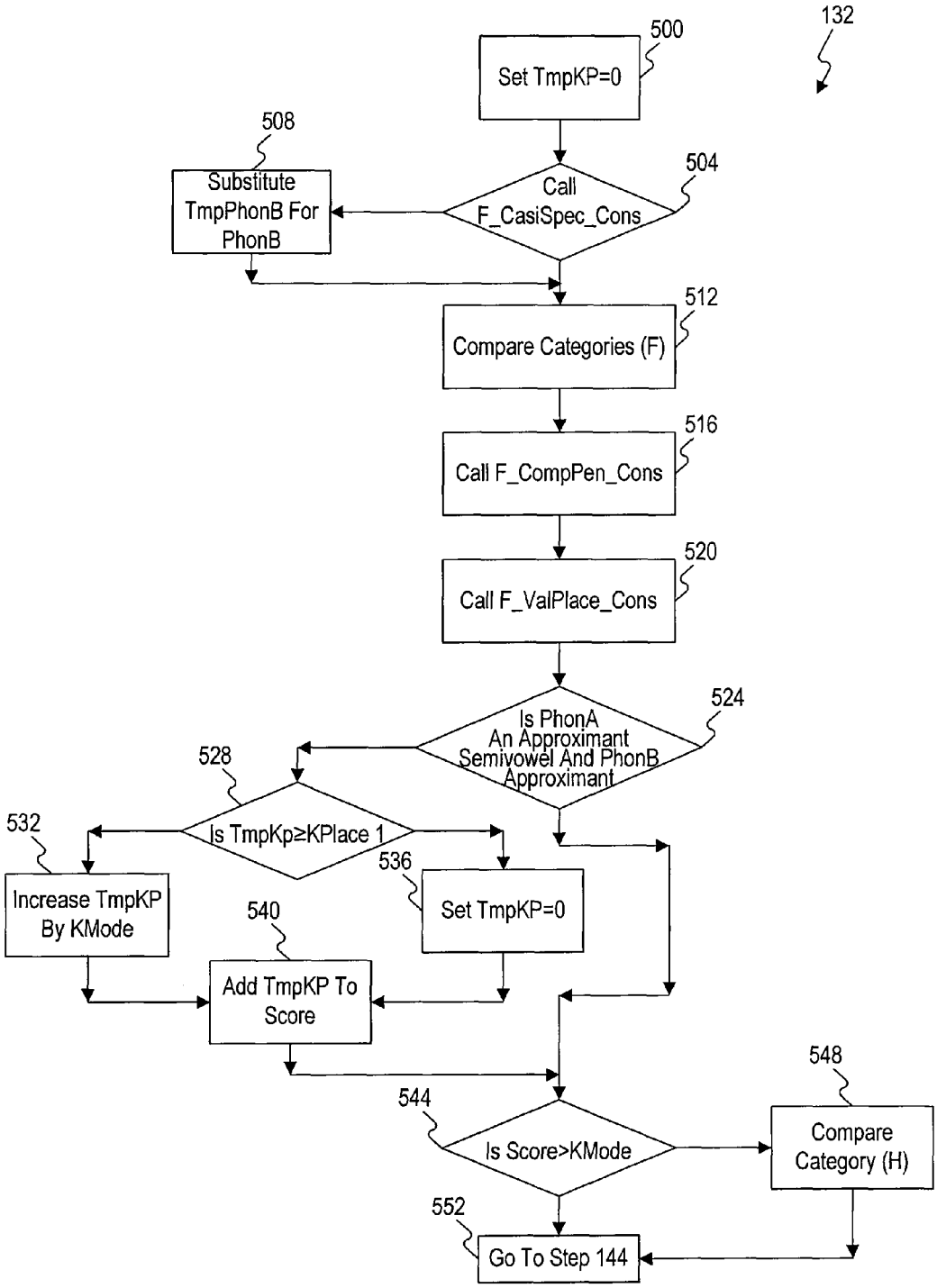
Figure 7:
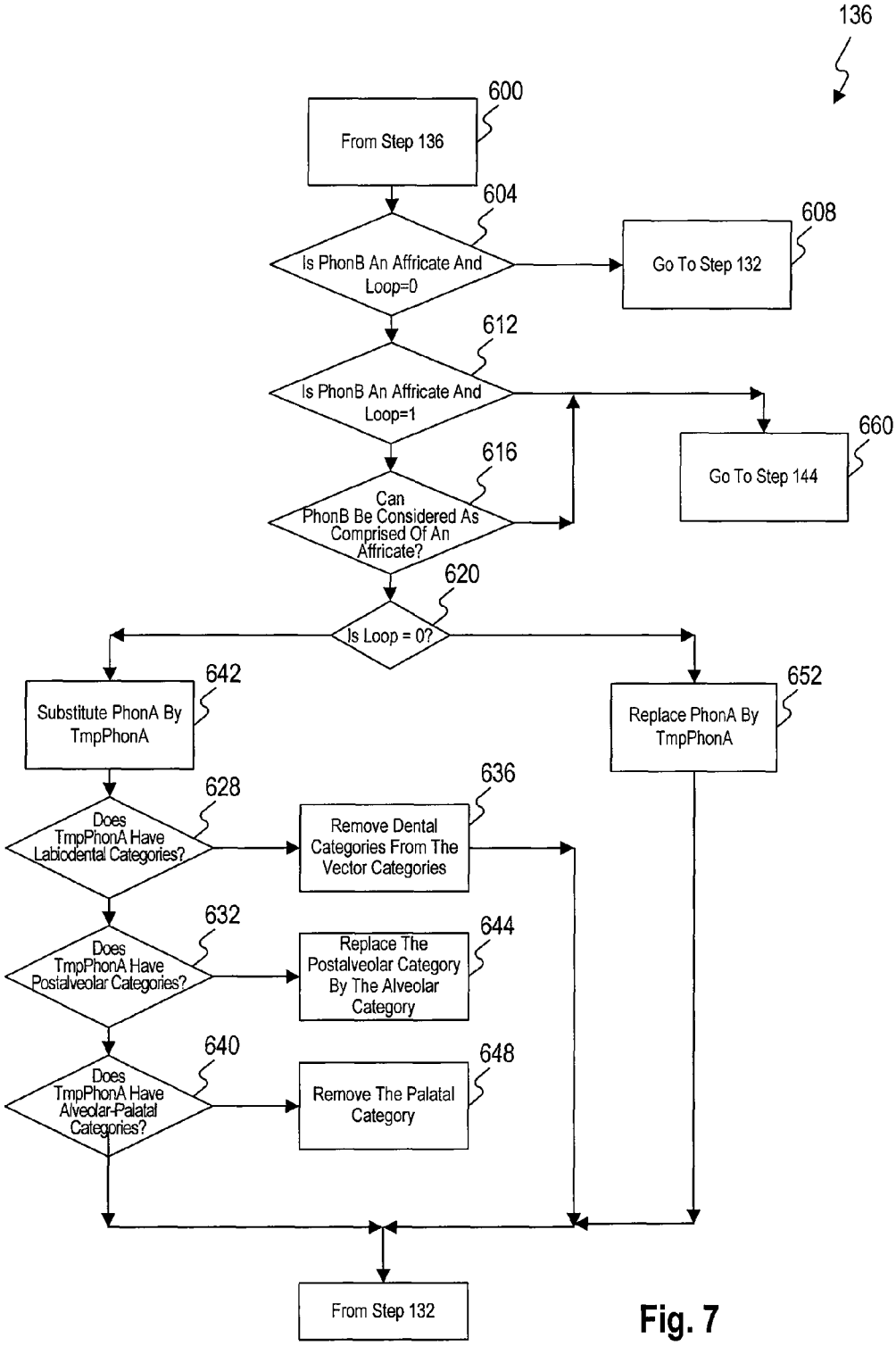

In a step 128 (comparison between consonants) a check is made as to whether PhonA is affricate. In the positive, in a step 136 the function described in the flow chart of FIG. 7 is activated. Alternatively, in a step 132 the function described in FIG. 6 is activated in order to compare the two consonants.

Figure 8:
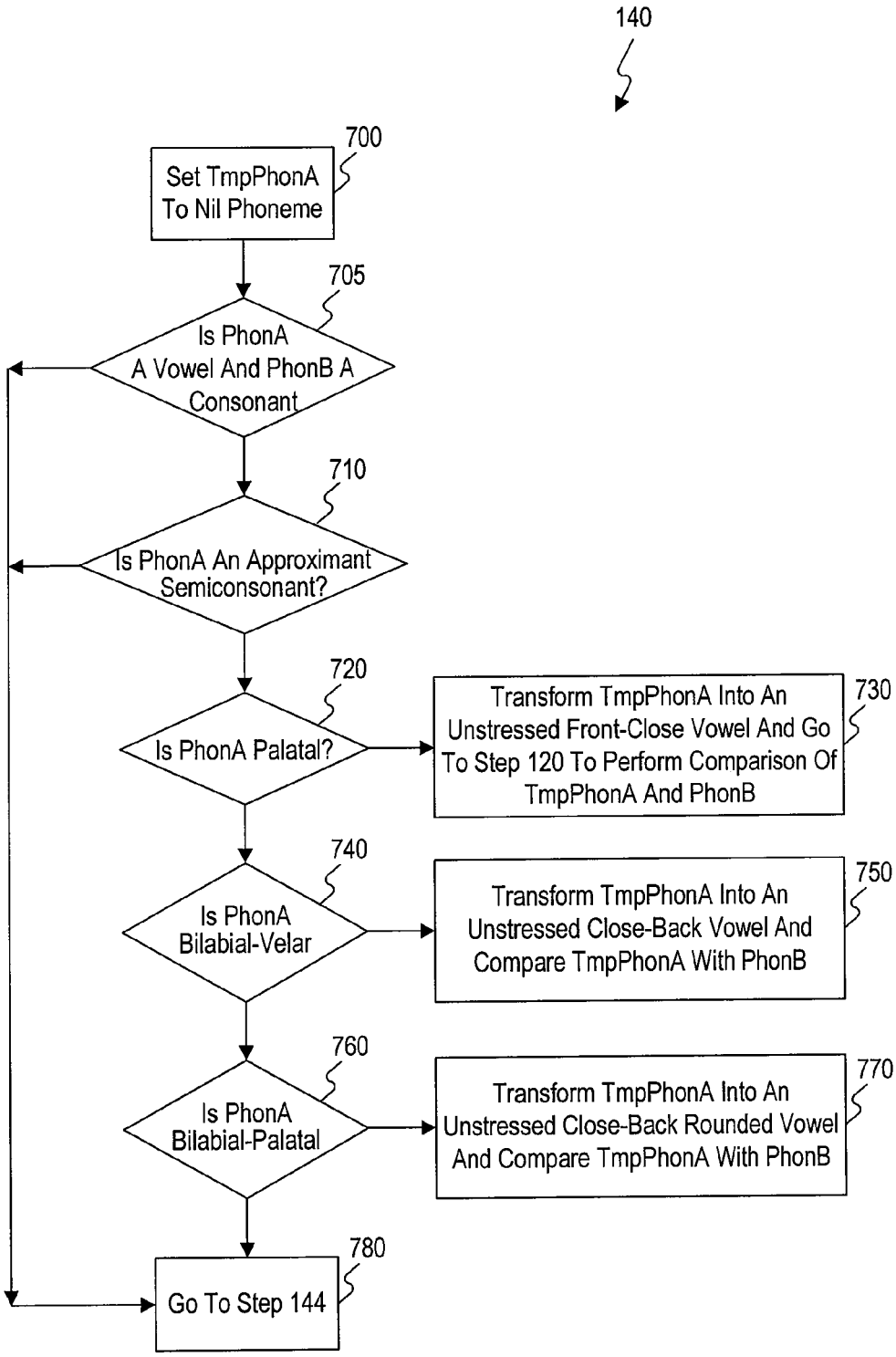

In a step 140 the functions described in the flowchart of FIG. 8 are activated as better detailed in the following.

Similarly better detailed in the following are theos criteria based on which the score may be modified in both steps 132 and 136.

Subsequently, the system evolves towards the step 144.

The results of comparison converge towards the step 144 where the score value (Score) is read.

In a step 148, the score value is compared with a value designated MaxCount. If the score value equals MaxCount the search is terminated, which means that a corresponding phoneme in a speaker voice language has been found for PhonA (step 152).

Figure 3:
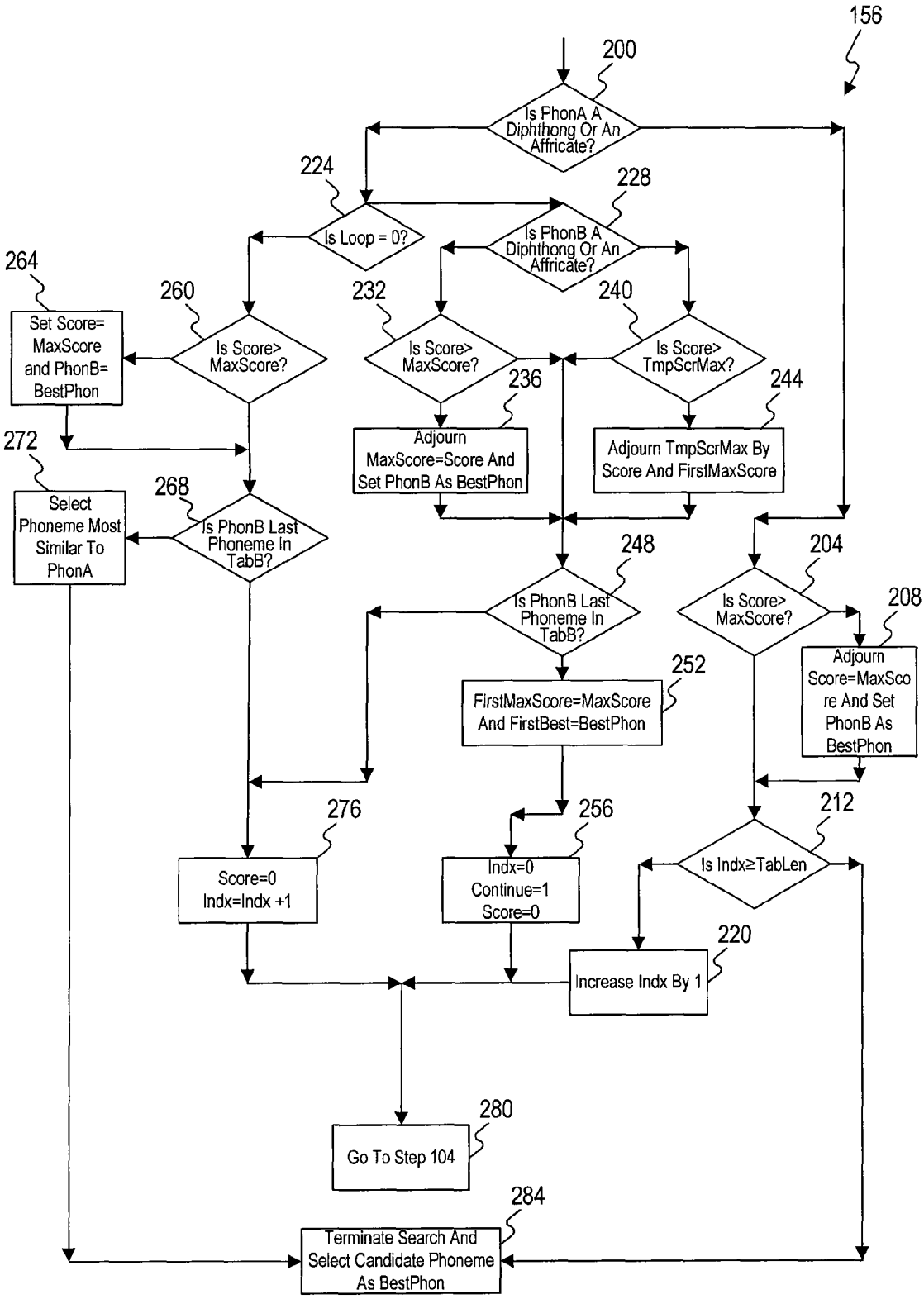

If the score value is lower than MaxCount (which is checked in a step 148), in a step 156 processing proceeds as described in the flow chart of FIG. 3.

In a step 160, the value Continue is compared with the value 1. In the positive (namely Continue equals 1), the system evolves back to step 104 after setting the value Loop to the value 1 and resetting Continue, Indx and Score to zero values. Alternatively, the system evolves towards the step 164.

From here, if PhonA is nasalized or rhoticized and the phoneme or the phonemes selected are not either of these kinds, the system evolves towards the step 168, where the phoneme/s selected is supplemented by a consonant from TabB whose phonetic-articolatory characteristics permit to simulate the nasalized or the rhoticized sound of PhonA.

In a step 172, the phoneme (or the phonemes) selected are sent towards the output phonetic mapping module 40 to be supplied to the module 50.

Figure 2:
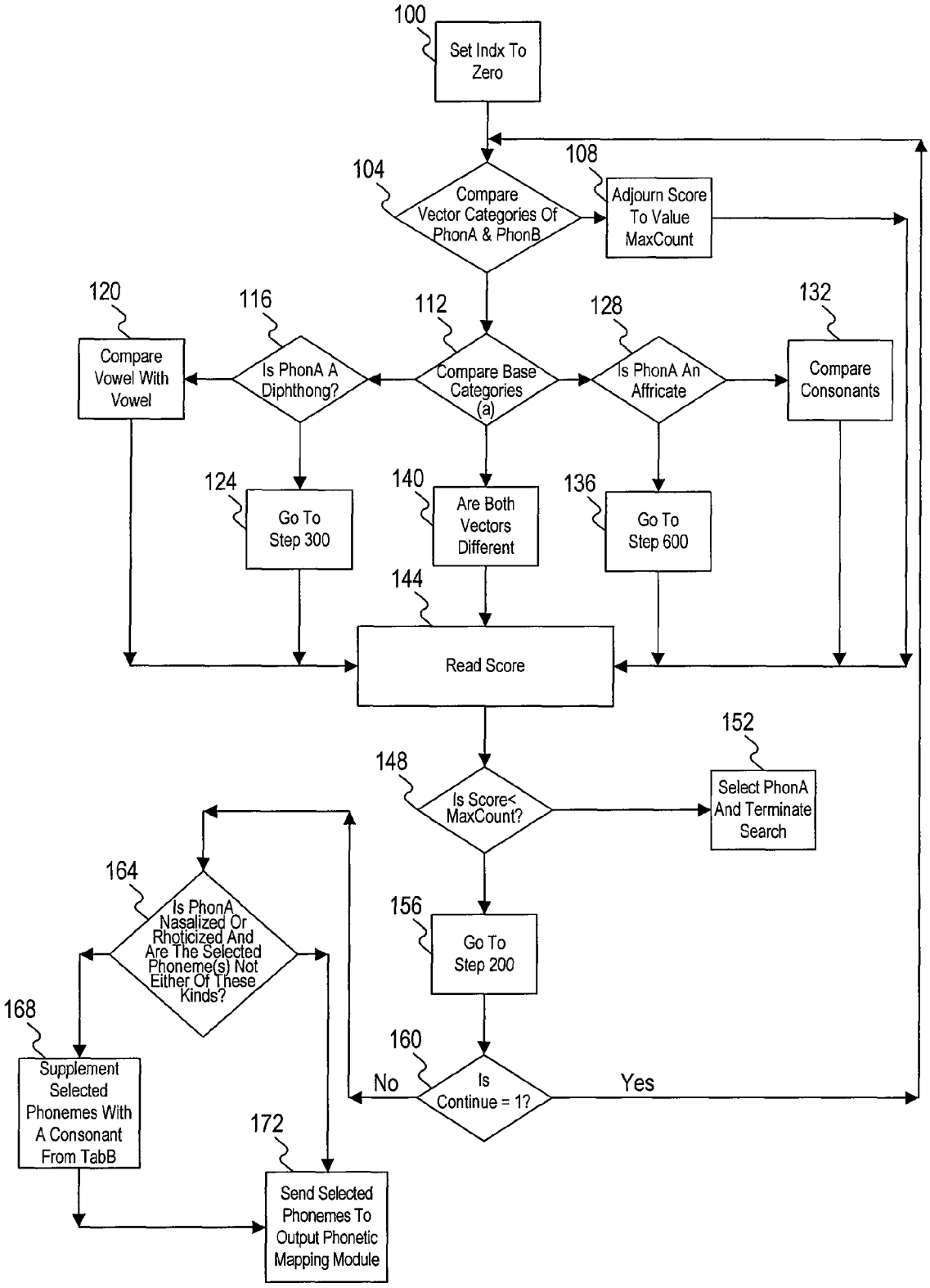

The step 200 of FIG. 3 is reached from the step 156 of the flow chart of FIG. 2.

From the step 200, the system evolves towards a step 224 if one of the two conditions is met:

PhonA is a diphthong to be mapped onto two vowels;

PhonA is affricate, PhonB is non-affricate consonant but may be the component of an affricate.

The parameter Loop indicates how many times the table TabB has been scanned from top to bottom. Its value may be 0 or 1.

Loop will be set to the value 1 only if PhonA is diphtong or affricate, whereby it is not possible to reach a step 204 with Loop equal to 1. In the step 204 the Maximum Condition is checked. This is a met if the score value (Score) is higher than MaxScore or if is equal thereto and the set of n phonetic features for PhonB is shorter than the set for BestPhon.

If the condition is met, the system evolves towards a step 208 where MaxScore is adjourned to the score value and PhonB becomes BestPhon.

In a step 212 Indx is compared with TabLen (the number of phonemes in TabB).

If Indx is higher than or equal to TabLen, the system evolves towards a step 284 to be described in the following.

If Indx is lower, then PhonB is not the last phoneme in the table and the system evolves towards a step 220, wherein Indx is increased by 1.

If PhonB is the last phoneme in the table, then the search is terminated and BestPhon (having associated the score MaxScore) is the candidate phoneme to substitute PhonA.

In a step 224 the value for Loop is checked.

If Loop is equal to 0, then the system evolves towards a step 228 where a check is made as to whether PhonB is diphthong or affricate.

In the positive (i.e. if PhonB is diphthong or affricate), the subsequent step is a step 232.

At this point, in a step 232 the Maximum Condition is checked between Score and MaxScore.

If the condition is met (i.e. Score is higher than MaxScore), in a step 236 MaxScore is adjourned to the value of Score and the PhonB becomes BestPhon.

In a step 240 (which is reached if the check of the step 228 shows that PhonB is neither diphthong nor affricate), a check is made as to whether a maximum condition exists between Score and TmpScrMAX (with the FirstBestComp in the place of BestPhon). If this is satisfied (i.e. Score is higher than TmpScrMAX), in a step 244 TmpScrMax is adjourned by means of Score and FirstBestComp by means of PhonB.

In a step 248, a check is made as to whether PhonB is the last phoneme in TabB (then Indx is equal to TabLen).

In the positive (252), the value for MaxScore is stored as the variable FirstMaxScore, BestPhon is stored as a FirstBest and subsequently , in a step 256, Indx is set to 0, while Continue is set to 1 (so that also the second component for PhonA will be searched), and Score is set to 0.

A step 260 is reached from the step 224 if Loop is equal to 1, namely if PhonB is scrutinized as a possible second component for PhonA. In a step 260, a check is made as to whether the maximum condition is satisfied in the comparison between Score and MaxScore (which pertains to BestPhon).

In a step 264, Score is stored in MaxScore and PhonB in BestPhon in the case the maximum condition is satisfied. In a step 268 a check is made as to whether PhonB is the last phoneme in the table and, in the positive, the system evolves towards the step 272.

In the step 272, a phoneme most similar to PhonA can be selected between a divisible phoneme or a couple of phonemes in the speaker language voice depending on whether the condition FirstMaxScore larger or equal than (TmpScrMax+MaxScore) is satisfied. The higher value of the two members of the relationship is stored as a MaxScore. In the case the choice falls on a pair of phonemes, this will be FirstBestCmp and BestPhon. Otherwise only FirstBest will be considered.

It is worth pointing out that BestPhon (found at the second iteration) cannot be diphthong or affricate. In a step 276, Indx is increased by 1 and Score is set to 0.

From the step 280 the system evolves back to the step 104.

The step 284 is reached from the step 272 (or the step 212) when the search is completed. In the step 284 a comparison is made between MaxScore and a threshold constant Thr. If MaxScore is higher, then the candidate phoneme (or the phoneme pair) is the substitute for PhonA. In the negative, PhonA is mapped onto the nil phoneme.

The flow chart of the FIG. 4 is a detailed description of the block 124 of the diagram of FIG. 2.

A step 300 is reached if PhonA is a diphthong.

In a step 302 a check is made as to whether PhonB is a diphthong and Loop is equal to 0. In the positive, the system evolves towards the step 304 where, after checking the features for PhonA, the system evolves towards a step 306 if PhonA is a diphthong to be mapped onto a single vowel.

The diphthongs of this type have a first component that is mid and central and the second component that is close-close-mid and back.

From the step 306 the system evolves towards the step 144.

In a step 308, the function comparing two diphthongs is called.

In a step 310, the categories (b) of the two phonemes are compared via that function and Score is increased by 1 for each common feature found.

In a step 312, the first components of the two diphthongs are compared and in a step 314 a function called F_CasiSpec_Voc is called for the two components.

This function performs three checks that are satisfied if:

- the components of the two diphthongs are indistinctly vowel open, or vowel open-open-mid, front and not rounded, or open-mid, back and not rounded;
- the component of PhonA is mid and central, and in TabB no phonemes exist exhibiting both categories, and PhonB is close-mid and front;
- the component of PhonA is close, front and rounded, or close-close-mid, front and rounded, and in TabB no phonemes exist having such features while PhonB is close, back, and rounded or close-close-mid, back and rounded.

If any of the three conditions is met, in a step 316 the value for Score is adjourned by adding (KOpen * 2) thereto.

Otherwise, in a step 318, a function F_ValPlace_Voc is called for the two components.

Such a function compares the categories front, central and back (categories (d)).

If identical, Score is incremented by Kopen; if they are different, a value is added to Score which is comprised of KOpen minus the constant DecrOpen if the distance between the two categories is 1, while Score is not incremented if the distance is 2.

A distance equal to one exists between central and front and between central and back, while a distance equal to two exists between front and back.

In step 320 a function F_ValOpen_Voc is called for comparing the two components of the diphthong. Specifically, F_ValOpen_Voc operates in cyclical manner by comparing the first components and the secondo components in two subsequnet iterations.

The function compares the categories (e) and adds to Score the constant KOpen less the value of the distance between the categories as reported in Table 1 hereinafter.

The matrix is symmetric, whereby only the upper portion was reported.

By making a numerical example, if PhonA is a close vowel and PhonB is a close-mid vowel, a value equal to (KOpen−(6 * Lstep)) will be added to Score which, by considering the value of the constants, is equal to 8.

In a step 322, if the components have both the rounded feature, the constant (KOpen+1) is added to Score. Conversely, if only one of the two is rounded, then Score is decremented by KOpen.

From the step 324 the system goes back to the step 314 if the two first components have been compared; conversely, a step 326 is reached when also the second components have been compared.

In the step 326, the comparison of the two diphthongs is terminated and the system evolves back to the step 144.

In a step 328 a check is made as to whether PhonB is a diphthong and Loop is equal to 1. If that is the case, the system evolves towards a step 306.

In a step 330, a check is made as to whether PhonA is a diphthong to be mapped onto a single vowel. If that is the case, in a step 331 Loop is checked and, if found equal to 1, the step 306 is reached.

In a step 332, a phoneme TmpPhonA is created.

TmpPhonA is a vowel without the diphthong characteristic and having close-mid, back and rounded features.

Subsequently, the system evolves to a step 334 where the TmpPhonA and PhonB are compared. The comparison is effected by calling the comparison function between two vowel phonemes without the diphthong category.

That function, which is called also at the step 120 in the flow chart of FIG. 2, is described in detail in FIG. 5.

In a step 336, the function is called to perform a comparison between a component of PhonA and PhonB: consequently, in a step 338, if Loop is equal to 0, the first component of PhonA is compared with PhonB (in a step 344). Conversely, if Loop is equal to 1, the second component of PhonA is compared with PhonB (in a step 340).

In the step 340, reference is made to the categories nasalized and rhoticized, by increasing Score by one for each identity found.

In a step 342, if PhonA bears a stress on its first component and PhonB is a stressed vowel, or if PhonA is unstressed or bears a stress on its second component and PhonB is an unstressed vowel, Score is incremented by 2. In all other cases it is decreased by 2.

In a step 344, if PhonA bears its stress on the second component and PhonB is a stressed vowel, or if PhonA is stressed on the first consonant or is an unstressed diphthong and PhonB is an unstressed vowel, then Score is increased by 2; conversely, it is decreased by 2 in all other cases.

In 348, the categories (d) and (e) of the first or second component of PhonA (depending on whether Loop is equal to 0 or 1, respectively) are compared with PhonB.

Comparison of the feature vectors and updating Score is performed based on the same principles already described in connection with the steps from 314 to 322.

A step 350 marks the return to step 144.

The flow chart of FIG. 5 describes in detail the step 120 of the diagram of FIG. 2, namely the comparison between two vowels that are not diphthongs.

In a step 400 a check is made as to whether PhonB is a diphthong. In the positive, the system evolves directly towards a step 470.

In a step 410, a comparison is made based on the categories (b) by increasing Score by 1 for each category found to be identical.

Conversely, in a step 420, the function F_CasiSpec_Voc already described in the foregoing is called in order to check whether one of the conditions of the function is met.

If that is the case, Score is increased by the quantity (KOpen * 2) in a step 430.

In the case of a negative outcome, in a step 440 function F_ValPlace_Voc is called.

Subsequently, in a step 450, the function F_ValOpen_Voc is called.

In a step 460, if both vowels have the rounding category, Score is increased by the constant (KOpen+1); if, conversely, only one phoneme is found to have the rounded category, then Score is decremented by KOpen.

A step 470 marks the end of the comparison, after which the system evolves back to the step 144.

The flow chart of FIG. 6 describes in detail the block 132 in the diagram of FIG. 1.

In a step 500 the two consonants are compared, while the variable TmpKP is set to 0 and the function F_CasiSpec_Cons is called in a step 504.

The function in question checks whether any of the following conditions are met;

1.0 PhonA uvular-fricative and in TabB there are no phonemes with these characteristics and PhonB is trill-alveolar;

1.1 PhonA uvular fricative and in TabB there are no phonemes with these characteristics PhonB is approximant-alveolar;

1.2 PhonA uvular fricative and in TabB there are no phonemes with these characteristics and PhonB is uvular-trill;

1.3 PhonA uvular fricative and in TabB there are no phonemes with these characteristics or with those of PhonB of 1.0 or 1.1 or 1.2, and PhonB is lateral-alveolar;

2.0 PhonA glottal fricative and in TabB there are no phonemes with these characteristics and PhonB is fricative-velar;

3.0 PhonA fricative-velar and in TabB there are no phonemes with these characteristics and PhonB is fricative-glottal or plosive-velar;

4.0 PhonA trill-alveolar and in TabB there are no phonemes with these characteristics and PhonB is fricative-uvular;

4.1 PhonA trill-alveolar and in TabB there are no phonemes with these characteristics and PhonB is approximant-alveolar;

4.2 PhonA trill-alveolar and in TabB there are no phonemes with these characteristics or with those of PhonB of 4.0 and 4.1, and PhonB is lateral-alveolar;

5.0 PhonA nasalized-velar and in TabB there are no phonemes with these characteristics and PhonB is nasalized-alveolar;

5.1 PhonA nasalized-velar and in TabB there are no phonemes with these characteristics or with those of PhonB of 5.0 and PhonB is nasalized-bilabial;

6.0 PhonA is fricative-dental-non voiced and in TabB there are no phonemes with these characteristics and PhonB is approximant-dental;

6.1 PhonA is fricative-dental-non voiced and in TabB there are no phonemes with these characteristics or with those of PhonB of 6.0, and PhonB is plosive-dental;

6.2 PhonA is fricative-dental-non voiced and in TabB there are no phonemes with these characteristics or those of PhonB of 6.0 and PhonB is plosive-alveolar;

7.0 PhonA is fricative-dental-voiced and in TabB there are no phonemes with these characteristics and PhonB is approximant-dental;

7.1 PhonA is fricative-dental-voiced and in TabB there are no phonemes with these characteristics or those of PhonB of 7.0 and PhonB is plosive-dental;

7.2 PhonA is fricative-dental-voiced and in TabB there are no phonemes with these characteristics or those of PhonB of 7.0 and PhonB is plosive-alveolar;

8.0 PhonA is fricative-palatal-alveolar-non voiced and in TabB there are no phonemes with these characteristics and PhonB is fricative-postalveolar;

8.1 PhonA is fricative-palatal-alveolar-non voiced and in TabB there are no phonemes with these characteristics or those of PhonB of 8.0 and PhonB is fricative-palatal;

9.0 PhonA is fricative-postalveolar e in TabB there are no phonemes with these characteristics or fricative-retroflex and PhonB is fricative-alveolar-palatal;

10.0 PhonA is fricative-postalveolar-velar and in TabB there are no phonemes with these characteristics and PhonB is fricative-alveolar-palatal;

10.1 PhonA is fricative-postalveolar-velar and in TabB there are no phonemes with these characteristics and PhonB is fricative -palatal;

10.2 PhonA is fricative-postalveolar-velar and in TabB there are no phonemes with these characteristics or those of 10.0 or 10.1 and PhonB is fricative-postalveolar;

11.0 PhonA is plosive-palatal and in TabB there are no phonemes with these characteristics and PhonB is lateral-palatal;

11.1 PhonA is plosive-palatal and in TabB there are no phonemes with these characteristics or those of PhonB di 11.0 and PhonB is fricative-palatal or approximant-palatal;

12.0 PhonA is fricative-bilabial-dental-voiced and in TabB there are no phonemes with these characteristics and PhonB is approximant-bilabial-voiced;

13.0 PhonA is fricative-palatal-voiced and in TabB there are no phonemes with these characteristics and PhonB is plosive-palatal-voiced or approximant-palatal-voiced;

14.0 PhonA is lateral-palatal and in TabB there are no phonemes with these characteristics and PhonB is plosive-palatal;

14.1 PhonA is lateral-palatal and in TabB there are no phonemes with these characteristics or those of PhonB of 14.0 and PhonB is fricative-palatal or approximant-palatal;

15.0 PhonA is approximant-dental and in TabB there are no phonemes with these characteristics and PhonB is plosive-dental or plosive-alveolar;

16.0 PhonA is approximant-bilabial and in TabB there are no phonemes with these characteristics and PhonB is plosive-bilabial;

17.0 PhonA is approximant-velar and in TabB there are no phonemes with these characteristics and PhonB is plosive-velar;

18.0 PhonA is approximant-alveolar and in TabB there are no phonemes with these characteristics and PhonB is trill-alveolar or fricative-uvular o trill-uvular;

18.1 PhonA is approximant-alveolar and in TabB there are no phonemes with these characteristics or those of PhonB in 18.0 and PhonB is lateral-alveolar.

If any of these conditions is met, the system evolves towards a step 508 where TmpPhonB is substituted for PhonB during the whole process of comparison up to a step 552.

If none of the conditions above is met, the system evolves directly towards a step 512 where the mode categories (f) are compared.

If PhonA and PhonB have the same category, then Score is increased by KMode.

In a step 516 a function F_CompPen_Cons is called to control if the following condition is met:

PhonA is fricative-postalveolar and PhonB (or TmpPhonB) is fricative-postalveolar-velar.

If the condition is met, then Score is decreased by KPlace1.

In a step 520 a function F_ValPlace_Cons is called to increment TmpKP based on what is reported in Table 2.

In the table in question the categories for PhonA are on the vertical axis and those for PhonB on the horizontal axis. Each cell includes a bonus value to be added to Score.

By assuming, by way of example, that PhonA has the category labiodental and PhonB the dental category only, then, by scanning the line for labiodental, and crossing the column for dental, one finds that the value Kplace2 will have to be added to Score.

In a step 524, a check is made as to whether PhonA is approximant-semivowel and PhonB (or TmpPhonB) is approximant. If the check yields a positive result, the system evolves towards a step 528, where a test is made on TmpKP.

Such a test is made in order to ensure that in the case the two phonemes being compared are both approximant and with identical place categories, their Score is higher than in the case of any comparison consonant-vocal.

If such a variable is larger or equal to KPlace1, then in a step 532 TmpKP is increased by KMode. In the negative, TmpKP is set to zero in a step 536.

In a step 540 the quantity TmpKP is added to Score.

In a step 544 a check is made as to whether Score is higher then KMode.

If that is the case, in a step 548 the categories (h) are compared with the exception of the semiconsonant category. For each identity found, Score is increased by one.

A step 552 marks the end of the comparison, after which the system evolves back to step 144 of FIG. 1.

The flow chart of FIG. 7 refers to the comparison between phonemes in the case PhonA is an affricate consonant (step 136 of FIG. 2).

In a step 600 the comparison is started and in a step 604 a check is made as to whether PhonB is affricate and Loop is equal to 0.

If that is the case, the system evolves towards a step 608, which in turn causes the system to evolve back to step 132.

In a step 612, a check is made as to whether PhonB is affricate and Loop is equal to 1.

If that is the case, a step 66o is directly reached.

In a step 616, a check is made as to whether PhonB can be considered as comprised of an affricate.

This cannot be the case if Loop is equal to 1 and PhonB has the categories fricative-postsalveolar-velar.

If that is the case, the system evolves to wards step 660.

In a step 620, a check is made for the value of Loop: if that is equal to 0, the system evolves towards a step 642.

In that step, PhonA is temporarily substituted in the comparison with PhonB by TmpPhonA; this has the same characteristics of PhonA, but for the fact that in the place of being affricate it is plosive.

In a step 628, a check is made as to whether TmpPhonA has the labiodental categories; if that is the case in a step 636, the dental categories removed from the vector of categories.

In a step 632, a check is made as to whether TmpPhonA has the postalveolar category; in the positive, such category is replaced in a step 644 by the alveolar category.

In a step 640, a check is made as to whether TmpPhonA has the categories alveolar-palatal; if that is the case the palatal category is removed.

In a step 652 phonA is temporarily replaced (until reaching the step 144) in comparison with PhonB by TmpPhonA; this has the same characteristics of PhonA, but for the fact that it is fricative in the place of being affricate.

A step 656 marks the evolution towards the comparison of the step 132 by comparing TmpPhonA with PhonB.

A step 660 marks the return to step 144.

The flow chart of FIG. 8 describes in detail the step 140 of the flow chart of FIG. 2.

A step 700 is reached if PhonA is consonant and PhonB is vowel or if PhonA is vowel and PhonB is consonant. The phoneme TmpPhonA is set as the nil phoneme.

In a step 705, a check is made as to whether PhonA is vowel and PhonB is consonant. In the positive the next step is step 780

In a step 710, a check is made as to whether PhonA is approximant-semiconsonant.

In the negative, the system evolves directly to a step 780.

In a step 720, a check is made as to whether PhonA is palatal. If that is the case, in a step 730 TmpPhonA is transformed into a unstressed-front-close vowel and the comparison of a step 120 is performed between TmpPhonA and PhonB.

In a step 740, a check is made as to whether PhonA is bilabial-velar. If that is the case, in a step 750 TmpPhonA is transformed into an unstressed-close-back-rounded vowel and the comparison of the step 120 (FIG. 2) is performed between TmpPhonA and PhonB.

In a step 760, a check is made as to whether PhonA is bilabial-palatal. If that is the case, in a step 770 TmpPhonA is transformed into an unstressed-close-back-rounded vowel and the comparison of the step 120 is carried out between TmpPhonA and PhonB.

A step 780 marks the evolution of the system back to the step 144.

In the following the two tables 1 and 2 repeatedly referred in the foregoing are reported.

TABLE 1

Distances of vowel features (e)

| | CLOSE | CLOSE-CLOSE-MID | CLOSE-MID | MID | OPEN-MID | OPEN-OPEN-MID | OPEN |
|---|---|---|---|---|---|---|---|
| CLOSE | 0 | 2 * LStep | 6 * LStep | 7 * LStep | 8 * LStep | 12 * LStep | 14 * LStep |
| CLOSE-CLOSE-MID | | 0 | 4 * LStep | 5 * LStep | 6 * LStep | 10 * LStep | 12 * LStep |
| CLOSE-MID | | | 0 | 1 * LStep | 2 * LStep | 6 * LStep | 8 * LStep |
| MID | | | | 0 | 1 * LStep | 5 * LStep | 7 * LStep |
| OPEN-MID | | | | | 0 | 4 * LStep | 6 * LStep |
| OPEN-OPEN-MID | | | | | | 0 | 2LStep |
| OPEN | | | | | | | 0 |

TABLE 2 values to be added to Score

| | BILABIAL | LABIODENTAL | DENTAL | ALVEOLAR | POST ALVEOLAR | RETROFLEX |
|---|---|---|---|---|---|---|
| BILABIAL | +KPlace1 | +KPlace2 | +0 | +0 | +0 | +0 |
| LABIODENTAL | +KPlace2 | +KPlace1 | +Kplace2 | +0 | +0 | +0 |
| DENTAL | +0 | +0 | +Kplace1 | +KPlace2 | +0 | +0 |
| ALVEOLAR | +0 | +0 | +Kplace3 | +KPlace1 | +KPlace2 | +KPlace3 |
| POSTALVEOLAR | +0 | +0 | +0 | +KPlace3 | +KPlace1 | +KPlace2 |
| RETROFLEX | +0 | +0 | +0 | +KPlace3 | +KPlace3 | +KPlace1 |
| PALATAL | +0 | +0 | +0 | +0 | +KPlace3 | +KPlace2 |
| VELAR | +0 | +0 | +0 | +0 | +0 | +0 |
| UVULAR | +0 | +0 | +0 | +KPlace2 | +0 | +0 |
| PHARYINGEAL | +0 | +0 | +0 | +0 | +0 | +0 |
| GLOTTAL | +0 | +0 | +0 | +0 | +0 | +0 |

| | PALATAL | VELAR | UVULAR | PHARYNGEAL | GLOTTAL |
|---|---|---|---|---|---|
| BILABIAL | +0 | +0 | +0 | +0 | +0 |
| LABIODENTAL | +0 | +0 | +0 | +0 | +0 |
| DENTAL | +0 | +0 | +0 | +0 | +0 |
| ALVEOLAR | +0 | +0 | +0 | +0 | +0 |
| POSTALVEOLAR | +0 | +0 | +0 | +0 | +0 |
| RETROFLEX | +KPlace2 | +0 | +0 | +0 | +0 |
| PALATAL | +KPlace1 | +KPlace2 | +0 | +0 | +0 |
| VELAR | +0 | +KPlace1 | +0 | +0 | +0 |
| UVULAR | +0 | +KPlace2 | +KPlace1 | +0 | +0 |
| PHARYINGEAL | +0 | +0 | +0 | +KPlace1 | +0 |
| GLOTTAL | +0 | +0 | +0 | +0 | +KPlace1 |

Of course, without prejudice to the underlying principles of the invention, the variance and embodiments may vary, also significantly, with respect to what has been described, by way of example only, without departing from the scope of the invention as defined by the annexed claims.

The invention claimed is:

1. A method for text-to-speech conversion of a text in a first language comprising sections in at least one second language, comprising the steps of:

converting said sections in said second language into phonemes of said second language;

mapping at least part of said phonemes of said second language onto sets of phonemes of said first language;

including said sets of phonemes of said first language resulting from said mapping in the stream of phonemes of said first language representative of said text to produce a resulting stream of phonemes; and generating a speech signal from said resulting stream of phonemes, wherein said step of mapping comprises:

carrying out non-acoustic similarity tests between each phoneme of said phonemes of said second language being mapped and a set of candidate mapping phonemes of said first language, said similarity tests performing a category-to-category comparison between a vector representative of phonetic categories of each of said phonemes of said second language and a vector representative of phonetic categories of each of said set of candidate mapping phonemes, said similarity test being independent of said first language and said second language;

assigning respective scores to the results of said tests; and mapping each said phoneme of said second language onto a set of mapping phonemes of said first language selected from said candidate mapping phonemes as a function of said scores.

2. The method of claim 1, comprising the step of mapping said phoneme of said second language into a set of mapping phonemes of said first language selected from:

a set of phonemes of said first language including three, two or one phonemes of said first language, or an empty set, whereby no phoneme is included in said resulting stream for said phoneme in said second language.

3. The method of claim 2, wherein said step of mapping comprises:

defining a threshold value for the results of said tests; and mapping onto said empty set of phonemes of said first language any phoneme of said second language for which any of said scores fails to reach said threshold value.

4. The method of claim 1, comprising the step of representing said phonemes of said second language and said candidate mapping phonemes of said first language as phonetic category vectors.

5. The method of claim 4, comprising selecting said phonetic categories from the group of:

(a) two basic categories of vowel and consonant;

(b) a category diphthong;

(c) vowel characteristics unstressed/stressed, non-syllabic, long, nasalized, rhoticized, or rounded;

(d) vowel categories front, central, or back;

(e) vowel categories close, close-close-mid, close-mid, mid, open-mid, open-open-mid, or open;

(f) consonant mode categories plosive, nasal, trill, tapflap, fricative, lateral-fricative, approximant, lateral, or affricate;

(g) consonant place categories bilabial, labiodental, dental, alveolar, postalveolar, retroflex, palatal, velar, uvular, pharyngeal, or glottal; and (h) other consonant categories voiced, long, syllabic, aspirated, unreleased, voiceless, or semiconsonant.

6. The method of claim 1, wherein said comparison is carried out on a category-to-category basis by allotting respective score values to said category-by-category comparisons, said respective score values being aggregated to generate said scores.

7. The method of claim 6, comprising the step of allotting differentiated weights to said score values in aggregating said respective score values to generate said scores.

8. The method of claim 1, comprising the step of pronouncing said resulting stream of phonemes by means of a speaker voice of said first language.

9. The system of claim 8, wherein said speech-synthesis module is configured for pronouncing said resulting stream of phonemes by means of a speaker voice of said first language.

10. A system for text-to-speech conversion of a text in a first language comprising sections in at least one second language, comprising:

a grapheme/phoneme transcriptor for converting said sections in said second language into phonemes of said second language;

a mapping module configured for mapping at least part of said phonemes of said second language onto sets of phonemes of said first language;

a speech-synthesis module adapted to be fed with a resulting stream of phonemes including said sets of phonemes of said first language resulting from said mapping and the stream of phonemes of said first language representative of said text, and to generate a speech signal from said resulting stream of phonemes, wherein said mapping module is configured for:

carrying out non-acoustic similarity tests between each phoneme of said phonemes of said second language being mapped and a set of candidate mapping phonemes of said first language, said similarity tests performing a category-to-category comparison between a vector representative of phonetic categories of each of said phonemes of said second language and a vector representative of phonetic categories of each of said set of candidate mapping phonemes, said similarity test being independent of said first language and said second language;

assigning respective scores to the results of said tests; and mapping each said phoneme of said second language onto a set of mapping phonemes of said first language selected from said candidate mapping phonemes as a function of said scores.

11. The system of claim 10, wherein said mapping module is configured for mapping said phoneme of said second language into a set of mapping phonemes of said first language selected from:

a set of phonemes of said first language including three, two or one phonemes of said first language, or an empty set, whereby no phoneme is included in said resulting stream for said phoneme in said second language.

12. The system of claim 11, wherein said mapping module is configured for:

defining a threshold value for the results of said tests; and mapping onto said empty set of phonemes of said first language any phoneme of said second language for which any of said scores fails to reach said threshold value.

13. The system of claim 10, wherein said phonemes of said second language and said candidate mapping phonemes of said first language are represented as phonetic category vectors.

14. The system of claim 13, wherein said mapping module is configured for operating based on phonetic categories from the group of:

(a) two basic categories of vowel and consonant;

(b) the category diphthong;

(c) vowel characteristics unstressed/stressed, non-syllabic, long, nasalized, rhoticized, or rounded;

(d) vowel categories front, central, or back;

(e) vowel categories close, close-close-mid, close-mid, mid, open-mid, open-open-mid, or open;

(f) consonant mode categories plosive, nasal, trill, tapflap, fricative, lateral-fricative, approximant, lateral, or affricate;

(g) consonant place categories bilabial, labiodental, dental, alveolar, postalveolar, retroflex, palatal, velar, uvular, pharyngeal, or glottal; and (h) other consonant categories voiced, long, syllabic, aspirated, unreleased, voiceless, or semiconsonant.

15. The system of claim 10, wherein said mapping module is configured for carrying out said comparison on a category-to-category basis by allotting respective score values to said category-by-category comparisons, said respective score values being aggregated to generate said scores.

16. The system of claim 15, wherein said mapping module is configured for allotting differentiated weights to said score values in aggregating said respective score values to generate said scores.

17. A non-transitory computer readable medium encoded with a computer program product loadable in a memory of at least one computer, the computer program product comprising software portions for performing the steps of the method of claim 1.

* * * * *